US005496490A

United States Patent [19]

Beagle et al.

[11] Patent Number: 5,496,490

[45] Date of Patent: Mar. 5, 1996

[54] LAUNDRY DETERGENT COMPOSITIONS CONTAINING LIPASE AND SOIL RELEASE POLYMER

[75] Inventors: Charles A. Beagle, S. Plainfield; Elliot M. Scherr, Princeton; Riad A. Taha, Spotswood, all of N.J.

[73] Assignee: Colgate-Palmolive Co., New York, N.Y.

[21] Appl. No.: 419,080

[22] Filed: Apr. 10, 1995

Related U.S. Application Data

[63] Continuation of Ser. No. 117844, Sep. 7, 1993, abandoned.

[51] Int. Cl.[6] ..... C11D 3/37; C11D 3/386

[52] U.S. Cl. ..... 252/135; 252/174.12; 252/174.21; 252/DIG. 12; 252/174.25; 134/25.5; 134/42

[58] Field of Search ..... 252/174.12, 174.21, 252/174.23, DIG. 12, 174.25, 135; 134/25.5, 42

[56] References Cited

U.S. PATENT DOCUMENTS

| | | | |
|---|---|---|---|
| 4,714,565 | 11/1987 | Wevers et al. | 252/174.19 |
| 4,785,060 | 11/1988 | Nagler | 252/444 |
| 4,861,512 | 9/1989 | Gosselink | 252/174.23 |
| 4,883,610 | 11/1989 | Ciallella | 252/559 |
| 4,908,039 | 5/1990 | Holland et al. | 8/137 |
| 5,026,400 | 6/1991 | Holland et al. | 8/137 |
| 5,110,506 | 5/1992 | Ciallella | 252/559 |
| 5,173,207 | 12/1992 | Drapier et al. | 252/99 |
| 5,174,927 | 12/1992 | Honsa | 252/543 |
| 5,223,179 | 6/1993 | Connor et al. | 252/548 |
| 5,225,100 | 6/1993 | Fry et al. | 252/174.25 |
| 5,290,475 | 3/1994 | Wixon | 252/174.23 |

*Primary Examiner*—Christine Skane
*Assistant Examiner*—Kery A. Fries
*Attorney, Agent, or Firm*—Bernard Lieberman; Murray M. Grill

[57] ABSTRACT

A particulate laundry detergent composition is provided having significantly improved oily soil removal activity. The composition comprises (a) from about 1 to 50%, by weight, of one or more detergent compounds selected from the group consisting of anionic, nonionic and amphoteric detergent compounds, and mixtures thereof; (b) a lipase enzyme in an amount effective for oily soil removal from stained fabric; and (c) a soil release polymer in an amount effective for oily soil removal from stained fabric. The laundry detergent compositions is characterized by its ability to remove a variety of oily soils from fabric to an extent greater than the additive soil removing effects measured with comparative compositions containing components (a) and (b), and components (a) and (c), respectively.

10 Claims, No Drawings

LAUNDRY DETERGENT COMPOSITIONS CONTAINING LIPASE AND SOIL RELEASE POLYMER

This is a Continuation, of application Ser. No. 08/117,844 filed Sep. 7, 1993, now abandoned.

FIELD OF THE INVENTION

This invention relates to particulate detergent compositions having enhanced oily soil removal activity. More particularly, this invention relates to particulate laundry detergent compositions containing, among other components, a soil release polymer in combination with lipase enzyme to provide a composition which is particularly effective for removing oily soils from fabric.

BACKGROUND OF THE INVENTION

The use of lipase in laundry detergent formulations to remove oily soils is well known in the art. U.S. Pat. No. 5,223,169 to El-Sayed et al describes the use of hydrolase enzymes including lipases for laundry applications. U.S. Pat. No. 5,069,810 to Holmes et al is directed to detergent compositions comprising microbial lipase and dodecylbenzene sulfonate.

Soil release polymers, and in particular, those commonly referred to as PET-POET copolymers (polyethylene terephthalate-polyoxyethylene terephthalate) have been widely suggested as components of detergent compositions. U.S. Pat. Nos. 4,569,772 and 4,571,303 to Ciallella describe nonionic detergent compositions containing stabilized PET-POET copolymers as soil release agents. Enzymes such as proteolytic and amylolytic enzymes are listed among the optional adjuvants.

U.S. Pat. No. 5,026,400 to Holland et al describes compositions containing narrow range ethoxylate nonionic detergents in combination with PET-POET copolymers and builders.

While detergent compositions containing soil release polymers have proven to be commercially successful as laundry compositions, the effective removal of oily stains from a variety of fabrics remains as a persistent problem area which commercial liquid and granular laundry formulations seek to address.

SUMMARY OF THE INVENTION

In accordance with the present invention, a particulate laundry detergent composition is provided having significantly improved oily soil removal activity. The composition comprises (a) from about 1 to 50%, by weight, of one or more detergent compounds selected from the group consisting of anionic and nonionic detergent compounds, and mixtures thereof; (b) a lipase enzyme in an amount effective for oily soil removal from stained fabric; and (c) a soil release polymer in an amount effective for oily soil removal from stained fabric; said laundry detergent composition being capable of removing a variety of oily soils from fabric to an extent greater than the additive soil removing effects measured with comparative compositions containing components (a) and (b), and components (a) and (c), respectively, each of said comparative compositions being devoid of any combination of said lipase enzyme and said soil release polymer.

In a preferred embodiment of the invention the soil release polymer is a copolymer of polyethylene terephthalate (PET) and polyoxyethylene terephthalate (POET) having a molecular weight of from about 15,000 to 50,000.

In accordance with the process of the invention laundering of fabrics soiled or stained with oily soils is effected by washing the fabrics to be laundered in an aqueous wash solution containing an effective amount of the above-defined particulate laundry detergent composition.

The present invention is predicated on the discovery that the combination of lipase enzyme and soil release polymer, particularly the PET-POET type copolymers, in a laundry detergent composition provides a synergistic interaction for removing oily soils from fabrics. The cleaning effects provided by compositions according to the invention exceed the additive cleaning effects provided by comparative detergent compositions similar to the compositions of the invention except they contain either lipase or soil release polymers, as the case may be, as individual components and not in combination.

DETAILED DESCRIPTION OF THE INVENTION

The soil release polymers useful in the present invention are preferably copolymers of polyethylene terephthalate (PET) and polyoxyethylene terephthalate (POET). They usually will be of molecular weights in the range of about 15,000 to 50,000 preferably in the range of about 19,000 to 43,000 and most preferably from about 19,000 to 25,000, e.g., about 22,000, according to molecular weight determinations performed on samples thereof that are usually employed herein. Such molecular weights are weight average molecular weights, as distinguished from number average molecular weights, which, in the case of the present polymers, are often lower. In the polymers utilized the polyoxyethylene will usually be of a molecular weight in the range of about 1,000 to 10,000, preferably about 2,500 to 5,000, more preferably 3,000 to 4,000, e.g., 3,400. In such polymers the molar ratio of polyethylene terephthalate to polyoxyethylene terephthalate units (considering

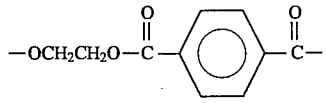

and

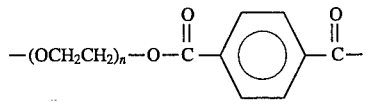

as such units) will be within the range of 2:1 to 6:1, preferably 5:2 to 5:1, more preferably 3:1 to 4:1, e.g., about 3:1. The proportion of ethylene oxide to phthalic moiety in the polymer will normally be at least 10:1 and often will be 20:1 or more, preferably being within the range of 20:1 to 30:1, and more preferably being about 22:1. Thus, it is seen that the polymer may be considered as being essentially a modified ethylene oxide polymer with the phthalic moiety being only a minor component thereof, whether calculated on a molar or weight basis.

Although the described PET-POET copolymer is that which is employed normally by applicants in accordance with the present invention, and that which is highly preferred for its desired functions, other PET-POET polymers, such as those described in U.S. Pat. No. 3,962,152 and British Patent Specification 1,088,984 may also be employed and can be effective soil release promoting agents in the compositions and methods of this invention.

The percentage of PET-POET copolymer in the detergent compositions of the invention may vary from about 0.5 to 10%, preferably from about 1 to 5%, by weight.

The lipase enzyme to be used according to the invention is of fungal or bacterial origin and suitable for use in detergent formulations to enhance the removal of fat or oil-containing stains typically resulting from frying fats and oils, salad dressing, human sebum and cosmetics such as lipstick. The preferred lipase enzymes have an activity optimum between pH values of 9 to 11. A particularly preferred lipolytic enzyme for use herein is "Lipolase 100 T"® marketed by Novo Industri A/S, DK-2880 Bagsvaerd, Denmark. The activity of this fungal-derived enzyme is about 100,000 units of lipase per gram of enzyme. The weight percent of lipase in the detergent compositions of the invention is generally from about 0.05 to 2%, preferably from about 0.1 to 1%, and most preferably in the range of 0.1 to 0.7%.

Any suitable nonionic detergent compound may be used as a surfactant in the present compositions, with many members thereof being described in the various annual issues of *Detergents and Emulsifiers,* by John W. McCutcheon. Such volumes give chemical formulas and trade names for commercial nonionic detergents marketed in the United States, and substantially all of such detergents can be employed in the present compositions. However, it is highly preferred that such nonionic detergent be a condensation product of ethylene oxide and higher fatty alcohol (although instead of the higher fatty alcohol, higher fatty acids and alkyl [octyl, nonyl and isooctyl] phenols may also be employed). The higher fatty moieties, such as the alkyls, of such alcohols and resulting condensation products, will normally be linear, of 10 to 18 carbon atoms, preferably of 10 to 16 carbon atoms, more preferably of 12 to 15 carbon atoms and sometimes most preferably of 12 to 14 carbon atoms. Because such fatty alcohols are normally available commercially only as mixtures, the numbers of carbon atoms given are necessarily averages but in some instances the ranges of numbers of carbon atoms may be actual limits for the alcohols employed and for the corresponding alkyls.

The ethylene oxide (EtO) contents of the nonionic detergents will normally be in the range of 3 to 15 moles of EtO per mole of higher fatty alcohol, although as much as 20 moles of EtO may be present. Preferably such EtO content will be 3 to 10 moles or 6 to 12 moles EtO per mole of alcohol and more preferably it will be 6 to 7 moles, e.g., 6.5 or 7 moles per mole of higher fatty alcohol (and per mole of nonionic detergent). As with the higher fatty alcohol, the polyethoxylate limits given are also limits on the averages of the numbers of EtO groups present in the condensation product. Examples of suitable nonionic detergents include those sold by Shell Chemical Company under the trademark Neodol®, including Neodol 25-7, Neodol 23-6.5 and Neodol 25-3.

Other useful nonionic detergent compounds include the alkylpolyglycoside and alkylpolysaccharide surfactants, which are well known and extensively described in the art.

Among the anionic surface active agents useful in the present invention are those surface active compounds which contain an organic hydrophobic group containing from about 8 to 26 carbon atoms and preferably from about 10 to 18 carbon atoms in their molecular structure and at least one water-solubilizing group selected from the group of sulfonate, sulfate, carboxylate, phosphorate and phosphate so as to form a water-soluble detergent.

Examples of suitable anionic detergents include soaps, such as, the water-soluble salts (e.g., the sodium potassium, ammonium and alkanol-ammonium salts) of higher fatty acids or resin salts containing from about 8 to 20 carbon atoms and preferably 10 to 18 carbon atoms. Particularly useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an aliphatic, preferably an alkyl radical containing from about 8 to 26, and preferably from about 12 to 22 carbon atoms. Examples of the sulfonated anionic detergents are the higher alkyl aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of from about 6 to 23 carbons and $R_1$ is an alkyl group containing from about 1 to 17 carbon atoms, or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites.

Other suitable anionic detergents are sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about ⅕ to ½ the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms. The proportion of ethylene oxide in the polyethoxylated higher alkanol sulfate is preferably 2 to 5 moles of ethylene oxide groups per mole of anionic detergent, with three moles being most preferred, especially when the higher alkanol is of 11 to 15 carbon atoms. A preferred polyethoxylated alcohol sulfate detergent is marketed by Shell Chemical Company as Neodol 25-3S.

The most highly preferred water-soluble anionic detergent compounds are the ammonium and substituted ammonium (such as mono, di and tri ethanolamine), alkali metal (such as, sodium and potassium) and alkaline earth metal (such as, calcium and magnesium) salts of the higher alkyl benzene sulfonates, olefine sulfonates and higher alkyl sulfates. Among the above-listed anionics, the most preferred are the sodium linear alkyl benzene sulfonates (LABS), and especially those wherein the alkyl group is a straight chain alkyl radical of 12 or 13 carbon atoms.

Amphoteric or ampholytic detergents may be used, if desired, to supplement the anionic and/or nonionic detergent in the composition of the invention. Ampholytic detergents are well known in the art and many operable detergents of this class are disclosed by A. M. Schwartz, J. W. Perry and J. Berch in "Surface Active Agents and Detergents," Interscience Publishers, N.Y., 1958, Vol. 2.

A preferred amphoteric surfactant is of the formula

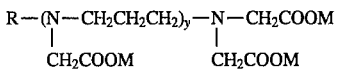

wherein R is an aliphatic hydrocarbonyl, preferably fatty alkyl or fatty alkylene, of 16 to 18 carbon atoms, M is alkali metal, and y is 3 to 4. More preferably R is tallowalkyl (which is a mixture of stearyl, palmityl and oleyl in the proportions in which they occur in tallow), M is sodium and y is about 3.5, representing a mixture of about equal parts of the amphoteric surfactant wherein y is 3 and such amphoteric surfactant wherein y is 4. Among the more preferred amphoteric surfactants of this type is that available commercially under the trade name AmpholakTM TM 7TX, which is obtainable from Kenobel AB, a unit of Nobel Industries, Sweden.

Builder materials may advantageously be included in the present compositions and may comprise any suitable water soluble or water insoluble builder, either inorganic or ogranic, providing that it is useful as a builder for the particular nonionic or anionic detergent compounds that may be employed. Such builders are well known to those of skill in the detergent art and include: alkali metal phosphates, such as alkali metal polyphosphates and pyrophosphates, including alkali metal tripolyphosphates; alkali metal silicates, including those of $Na_2O:SiO_2$ ratio in the range of 1:1.6 to 1:3.0, preferably 1:2.0 to 1:2.8, and more preferably 1:2.35 or 1:2.4; alkali metal carbonates; alkali metal bicarbonates; alkali metal sesquicarbonates (which may be considered to be a mixture of alkali metal carbonates and alkali metal bicarbonates); alkali metal borates, e.g., borox; alkali metal citrates; alkali metal gluconates; alkali metal nitrilotriacetates; zeolites, preferably hydrated zeolites, such as hydrated Zeolite A, Zeolite X and Zeolite Y; and mixtures of individual builders within one or more of such types of builders. Preferably the builders will be sodium salts and will also be inorganic. A highly preferred non-phosphate mixed water soluble and water insoluble builder composition comprises carbonate, bicarbonate and zeolite builders. Phosphate-containing builder systems will usually be based on alkali metal (sodium) tripolyphosphate and silicate builders, with such silicate being in relatively minor proportion.

Zeolite A-type aluminosilicate builder, usually hydrated, with about 15 to 25% of water of hydration is particularly advantageous for the present invention. Hydrated zeolites X and Y may be useful too, as may be naturally occurring zeolites that can act as detergent builders. Of the various zeolite A products, zeolite 4A, a type of zeolite molecule wherein the pore size is about 4 Angstroms, is often preferred. This type of zeolite is well known in the art and methods for its manufacture are described in the art such as in U.S. Pat. No. 3,114,603.

The zeolite builders are generally of the formula $$(Na_2O)_x \cdot (Al_2O_3)_y \cdot (SiO_2)_z \cdot wH_2O$$

wherein x is 1, y is from 0.8 to 1.2, preferably about 1, z is from 1.5 to 3.5, preferably 2 or 3 or about 2, and w is from 0 to 9, preferably 2.5 to 6. The crystalline types of zeolite which may be employed herein include those described in "Zeolite Molecular Series" by Donald Breck, published in 1974 by John Wiley & Sons, typical commercially available zeolites being listed in Table 9.6 at pages 747–749 of the text, such Table being incorporated herein by reference.

The zeolite builder should be a univalent cation exchanging zeolite, i.e., it should be aluminosilicate of a univalent cation such as sodium, potassium, lithium (when practicable) or other alkali metal, or ammonium. A zeolite having an alkali metal cation, especially sodium, is most preferred, as is indicated in the formula shown above. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eg./g., on an anhydrous zeolite basis.

Other components may be present in the detergent compositions to improve the properties and in some cases, to act as diluents or fillers. Among the suitable fillers, the most preferred is sodium sulfate. Illustrative of suitable adjuvants are enzymes supplementary to the lipase which is an integral component of the present compositions to further promote cleaning of certain hard to remove stains from laundry or hard surfaces. Among enzymes, the proteolytic and amylolytic enzymes are most useful to supplement the lipase. Other useful adjuvants are foaming agents, such as lauric myristic diethanolamide, when foam is desired, and antifoams, when desired, such as dimethyl silicone fluids. Also useful are bleaches, such as sodium perborate, which may be accompanied by suitable activator(s) to promote bleaching actions in warm or cold water. Flow promoting agents, such as hydrated synthetic calcium silicate, which is sold under the trademark Microcel®C, may be employed in relatively small proportions. Other adjuvants usually present in detergent compositions include fluorescent brighteners, such as stilbene brighteners, colorants such as dyes and pigments and perfume.

EXAMPLE 1

The efficacy of the composition of the invention in removing oily soils and stains from fabrics was tested in a cleaning test known as a multi-stain test in which a variety of stains such as liquid make-up, sebum/particulate soil, steak sauce, French dressing, red Crisco shortening, among others was deposited on a variety of fabrics including doubleknit Dacron®, cotton percale, and cotton/polyester blend, fabrics likely to be present in a family wash. To evaluate the synergistic effects achieved with the compositions of the invention, comparative cleaning tests were conducted using three detergent compositions identical to the particular composition of the invention except such comparative compositions did not contain either soil release polymer, or lipase enzyme or both, as the case may be.

The tests were carried out in a top loading automatic washing machine of 28 liter capacity with wash water at 77° F. having a hardness of about 150 ppm as calcium carbonate (mixed calcium and magnesium hardness) using a 10 minute wash cycle after which the laundry is rinsed, spin dried and subsequently dried in an automatic laundry dryer with a 30 minute drying cycle. Next, the light reflectances of the swatches are read and averaged. Subsequently, the swatches are stained, as by dirty motor oil (usually three drops per swatch) and allowed to age overnight. The next day the reflectances of the stained swatches are measured and the swatches are then washed and dried in the manner previously described, followed by measurements of the reflectances of the freshly washed swatches.

If the reflectance of the unstained swatch is $Rd_1$ and that of the stained swatch before washing is $Rd_2$, with the final reflectance being Rds, the percentage of soil removal is $[(Rd_3-Rd_2)/(Rd_1-Rd_2)]\times100$. Of course, averages are taken for a plurality of swatches employed so that the average percentage of soil removal for a particular stain on a particular material, or for a variety of stains on a variety of materials, may be found.

A multi-stain test as described above was conducted using as the comparative base detergent, a commercial laundry powder composition designated herein as Control A and defined below.

The evaluation of oily soily removal from stained fabrics was measured in the Examples herein by one of two alternative calculations:

(1) the percentage of soil removal as defined above; and (2) ΔRd values or changes in reflectance when comparing a soiled fabric cleaned with a test composition versus the ΔRd value obtained when using a control composition.

| CONTROL A | |
|---|---|
| COMPONENT | WEIGHT PERCENT |
| Water | 10.8 |
| Sodium Silicate | 2.8 |
| Sodium Tripolyphosphate | 35.0 |
| Non-Ionic Surfactant[1] | 10 |
| Sodium Carbonate | 15 |
| Sodium Sulfate | 13.7 |
| Sodium Aluminum Silicate | 12 |
| Brightener | 0.2 |
| Perfume | 0.2 |

[1]Condensation product of $C_{12}$–$C_{15}$ linear alcohol and an average of 7 moles of ethylene oxide per mole of alcohol (Neodol 25-7 marketed by Shell Chemical Company).

The soil release polymers used in the tests described herein are composed, in part, of a polymer referred to as QCF which is a PET-POET copolymer with a molecular weight in the range of about 15,000 to 50,000, but more usually in the preferred range of about 19,000 to 43,000. The mole ratio of polyethylene terephthalate to polyoxyethylene terephthalate units is about 3:1. Two commercial soil release polymers which were used in the tests are designated herein as SRP-1 and SRP-3. SRP-1 is a solid mixture of 80% QCF and 20% sodium polyacrylate; SRP-3 is a mixture of 50% QCF and 50% sodium sulfate-both are marketed by Rhone-Poulenc.

The results of a first and third wash multi-stain test expressed as ΔRd values or the change in reflectance versus Control A is shown below in Table 1. A ΔRd value of 1 unit or greater is considered a statistically significant difference in cleaning. A ΔRd of 0.5 or greater is a difference which can be perceived by the human eye.

TABLE 1

Oily Stain Set - Results of first and third washes Δ Rd values versus Control A

The compositions of the various detergent compositions designated in the Table are provided below:
Neat = 34.5 g of Control A
SRP = Neat + 0.35 g of SRP1(~1% by weight per dose).
Lipase = Neat + 0.20 g of Novo Lipolase 100T Lipase enzyme (~0.5%, by weight, per dose).
SRP & Lipase = Neat + 0.35 g of SRP1 + 0.20 g Lipolase 100 T, Lipase enzyme.

| | FIRST WASH | | | THIRD WASH | | |
|---|---|---|---|---|---|---|
| STAIN | SRP vs Neat | LIPASE vs Neat | SRP & LIP vs Neat | SRP vs Neat | LIPASE vs Neat | SRP & LIP vs Neat |
| LM 65/35 | −4 | −3 | −3 | 0 | −2 | +2 |
| LM-DDK | −6 | −4 | +2 | −1 | −3 | +6 |
| LM-Cot | −2 | −3 | −4 | +1 | −1 | 0 |
| SS Cot. | −4 | −2 | −3 | −4 | −2 | −2 |
| SS-65/35 | 0 | −1 | −2 | +2 | +2 | 0 |
| SS-DDK | +1 | −7 | 0 | +3 | −5 | +3 |
| RC-DDK | −2 | −1 | −1 | +4 | −1 | +4 |
| BBQ-DDK | +5 | −3 | +10 | +4 | −1 | +5 |
| FD-DDK | +2 | 0 | +6 | +3 | −1 | +5 |
| A1-65/35 | +3 | +4 | +3 | +1 | +3 | +3 |
| Δ Sum Rd | −7 | −20 | +8 | +13 | −11 | +26 |

LM = Liquid Makeup; SS = Spangler Sebum Particulate; RC = Red Crisco; BBQ = Barbecue Sauce; FD = French Dressing; A1 = Steak Sauce; DDK = Dacron Double Knit; Cot. = Cotton Percale; 65/35 = Cotton/Polyester blend.

As shown in Table 1, the composition of the invention, SRP and Lipase, demonstrated a significant improvement in oily soil removal from cotton blends and polyester relative to cleaning achieved with the various comparative detergent compositions, especially after the third wash, with particularly good results noted for the removal of liquid make-up, barbecue sauce and French dressing stains.

EXAMPLE 2

A multi-stain test was conducted by hand wash using as the comparative base detergent a commercial laundry powder composition described below and designated herein as Control B.

| CONTROL B | |
|---|---|
| COMPONENT | WEIGHT PERCENT |
| Linear Alkyl Benzene Sulfonate | 19.0 |
| Sodium Tripolyphosphate | 15.0 |
| Sodium Carbonate | 7.5 |
| Sodium Silicate | 7.5 |
| Sodium Sulfate | 42.3 |
| Water | 6.5 |
| Amylase/Protease Enzymes | 0.35 |

-continued

| CONTROL B | |
|---|---|
| COMPONENT | WEIGHT PERCENT |
| Sodium Polyacrylate | 1.6 |
| Perfume | 0.25 |

The results of a first wash multi-stain test expressed as a change in percent soil removal versus Control B is shown in Table 2. A change in the percent soil removal of two percent or greater is statistically significant.

TABLE 2

Results of first wash Δ% stain removal values versus Control B

The compositions of the various detergent compositions designated in the Table are provided below.
Neat = 214 grams of Control B
0.35% Lipase = Neat + 0.35% (by weight of Neat) of Novo Lipolase 100T Lipase enzyme.
0.13% Lipase = Neat + 0.13% (by weight of Neat) of Lipolase 100T Lipase enzyme).
0.93% SRP = Neat + 0.93% (by weight of Neat) of SRP-1.

| STAIN | 0.35% LIPASE vs Neat | 1.77% SRP vs Neat | .93% SRP & .13% LIP vs Neat |
|---|---|---|---|
| LM-65/35 | −1 | 3 | 0 |
| LM-DDK | −2 | 0 | 1 |
| LM-Cot | 1 | 2 | 6 |
| SS-Cot | 3 | −5 | −5 |
| S-65/35 | 0 | 4 | 1 |
| SS-DDK | 1 | −2 | 3 |
| RC-DDK | 1 | 3 | 4 |
| BBQ-DDK | 3 | −2 | 24 |
| FD-DDK | −1 | 1 | 9 |
| A1-65/35 | 0 | 1 | 1 |
| Δ Sum Rd | 5 | 5 | 44 |

LM = Liquid Makeup; SS — Spangler Sebum Particulate; RC — Red Crisco; BBQ = Barbecue Sauce; FD = French Dressing; A1 = Steak Sauce; DDK = Dacron Double Knit; Cot = Cotton Percale; 65/35 = Cotton/Polyester blend.

As demonstrated in Table 2, the composition of the invention significantly increased the cleaning of oily soils from Dacron Double Knit and cotton. The synergistic interaction of soil release polymer and lipase enzyme in accordance with the invention was particularly effective in removing the following stains: barbecue sauce; French dressing; liquid make-up; and red Crisco oil.

EXAMPLE 3

A single stain test with motor oil was conducted using automatic washing machines according to the test protocol described in Example 1 except that the machines used had a capacity of 64 liters of water. The comparative base detergent was a commercial No-P laundry powder detergent described below and designated herein as Control C.

| CONTROL C | |
|---|---|
| COMPONENT | WEIGHT PERCENT |
| Water | 8 |
| TEA-DBS[1] | 1.4 |
| Nonionic Surfactant[2] | 11.2 |
| Sodium Carbonate | 23.3 |
| Sodium Sulfate | 16.9 |
| Zeolite A | 35.6 |
| Brightener | 0.3 |
| Polyacrylate | 3 |

-continued

| CONTROL C | |
|---|---|
| COMPONENT | WEIGHT PERCENT |
| Perfume | 0.3 |

[1]A mixture of triethanol amine and dodecyl benzene sulfate
[2]Condensation product of $C_{12}$–$C_{15}$ linear alcohol and an average of 7 moles of EO per mole of alcohol.

The results of the single stain test are shown in Table 3 wherein the percentage soil removal is compared for four fabrics. A measured percentage change of two percent or greater is considered statistically significant.

TABLE 3

Percent Soil Removal of Dirty Motor Oil Stain Versus Control C

The compositions of the various detergent compositions designated in the Table are provided below.
Neat = 65 grams of Control C
Neat + SRP1 = Neat + 0.65 g SRP-1 (~1% by weight per dose).
Neat + Lipase = Neat + 0.38 g of Novo Lipolase 100T Lipase
Neat + Lipase + SRP-1 = Neat + 0.38 g of Novo Lipolase 100T Lipase + 0.65 g SRP-1 (all as defined above).

| | Dacron Single Knit | Dacron Double Knit | Poplin (65/35) | Dacron 65% Cotton 35% |
|---|---|---|---|---|
| Neat | −2.0 | 3.9 | 15.7 | 20.3 |
| Neat + SRP-1 | 96.6 | 68.5 | 27.2 | 47.5 |
| Neat + Lipase | 0.0 | 1.8 | 19.2 | 22.9 |
| Neat + Lipase + SRP-1 | 96.8 | 83.9 | 28.5 | 40.1 |

Table 3 demonstrates the synergistic improvement achieved in removing motor oil stain from Dacron Double Knit fabric when laundering with the composition of the invention relative to laundering with a commercial laundry detergent as a control composition. The percent soil removal of nearly 84% which was noted when using the composition of the invention far exceeds the individual cleaning effects of 1.8% and 68.5% which were achieved with the addition of lipase enzyme and soil release polymer, respectively, to the control composition.

EXAMPLE 4

A stain test was performed using Control A defined above as the comparative detergent formulation. As noted in Table 4 the removal of a chocolate fudge pudding stain during laundering was significantly enhanced by the use of the composition of the invention.

TABLE 4

Chocolate Fudge Pudding Stain Test - Results of First Wash, Δ Rd values versus Control A Neat = 34.5 g of Control A
SRP = Neat + 0.35 g of SRP1 (~1% by weight per dose)
Lipase = Neat + 0.20 g of Novo Lipolase 100T Lipase enzyme (~0.5% by weight per dose.)
SRP & Lipase = Neat + 0.35 g of SPR1 + 0.20 g of Novo Lipolase 100T Lipase enzyme.

| STAIN: | SRP VS. NEAT | LIPASE VS. NEAT | SRP & LIP VS NEAT |
|---|---|---|---|
| Chocolate Fudge Pudding (65/35 | +3 | +1 | +5 |

TABLE 4-continued

Chocolate Fudge Pudding Stain Test - Results of First Wash, Δ Rd values versus Control A Neat = 34.5 g of Control A
SRP = Neat + 0.35 g of SRP1 (~1% by weight per dose)
Lipase = Neat + 0.20 g of Novo Lipolase 100T Lipase enzyme (~0.5% by weight per dose.)
SRP & Lipase = Neat + 0.35 g of SPR1 + 0.20 g of Novo Lipolase 100T Lipase enzyme.

| STAIN: | SRP VS. NEAT | LIPASE VS. NEAT | SRP & LIP VS NEAT |
|---|---|---|---|
| Dacron/Cotton) | | | |

We claim:

1. A particulate laundry detergent composition having significantly improved oily soil removal activity comprising, by weight, (a) from about 1% to 50% of one or more detergent compounds selected from the group consisting of anionic sulfated or sulfonated detergents and C10–C18 alcohol ethylene oxide condensate nonionic detergents and mixtures thereof; (b) 0.1% to 1.0% of a lipase enzyme in an amount effective for oily soil removal from stained fabric; (c) 0.5% to 10% of a soil release copolymer of polyethylene terephthalate (PET) and polyoxyethylene terephthalate (POET) having a molecular weight in the range of about 15,000 to 50,000 wherein the polyoxyethylene (POET) is of a molecular weight in the range of about 1,000 to 10,000 and the molar ratio of PET to POET units is from 2:1 to 6:1, in an amount effective for oily soil removal from stained fabric; and (d) from about 10% to 75% of a water soluble or water insoluble, inorganic or organic builder for said detergent compound; said laundry detergent composition being capable of removing a variety of oily soils from fabric to an extent greater than the additive soil removing effects measured with comparative compositions containing components (a), (b) and (d) or (a), (c) and (d) respectively, each of said comparative compositions being devoid of any combination of said lipase enzyme and said soil release copolymer.

2. A detergent composition according to claim 1 wherein the PET-POET copolymer is of a molecular weight in the range of about 19,000 to 43,000 and the POET is of a molecular weight in the range of about 2,500 to 5,000.

3. A detergent composition according to claim 1 comprising from about 5 to 20%, by weight, of a nonionic detergent.

4. A detergent composition according to claim 3 wherein said nonionic detergent is the condensation product of a higher fatty alcohol having from 12 to 15 carbon atoms and 6 to 12 moles of ethylene oxide per mole of alcohol.

5. A detergent composition according to claim 1 wherein said lipase enzyme is a fungus-derived enzyme.

6. A detergent composition according to claim 1 wherein said lipase enzyme has an activity of about 100,000 units of lipase per gram of enzyme.

7. A detergent composition according to claim 6 wherein the builder is a mixture of sodium tripolyphosphate and sodium carbonate.

8. A detergent composition according to claim 6 wherein the builder is a mixture of sodium carbonate and zeolite A.

9. A method of washing laundry and removing oily soils from stained fabrics which comprises washing the fabrics to be laundered in an aqueous wash solution containing an effective amount of the composition of claim 1.

10. A method according to claim 9 wherein the laundry is washed repetitively with said composition following intermediate soilings of the previously washed fabrics.

* * * * *